United States Patent [19]

Martin

[11] 4,327,567

[45] May 4, 1982

[54] TUBING EXPANDER FOR BOILER TUBES OR THE LIKE

[75] Inventor: Paul W. Martin, Springfield, Ohio

[73] Assignee: Dresser Industries, Inc., Dallas, Tex.

[21] Appl. No.: 119,596

[22] Filed: Feb. 7, 1980

[51] Int. Cl.[3] ..... B21D 39/06

[52] U.S. Cl. ..... 72/119; 72/123; 72/125; 29/727

[58] Field of Search ..... 72/119, 122, 123, 125; 408/112, 241 S

[56] References Cited

U.S. PATENT DOCUMENTS

| | | | |
|---|---|---|---|
| 2,359,859 | 10/1944 | Jarvis | 408/112 |
| 2,608,114 | 8/1952 | Martin et al. | 408/112 |
| 2,905,030 | 9/1959 | Cogsdill | 408/112 |
| 3,320,832 | 5/1967 | Jensen | 408/112 |
| 3,353,386 | 11/1967 | Fisher | 72/119 |
| 4,134,286 | 1/1979 | Martin | 72/122 |

OTHER PUBLICATIONS

Dresser Industries *Airetool Catalogue* No. 74.

*Primary Examiner*—Lowell A. Larson
*Attorney, Agent, or Firm*—Roy L. Van Winkle

[57] ABSTRACT

An improved expander of this invention is used for expanding tubes into tube sheets and flaring the ends extending therefrom, such as is common practice in the manufacture of boilers. The improved expander includes both straight rolls for expanding the tubes and tapered rolls for flaring the tube ends. The rolls are carried by a cage that encircles a tapered mandrel, which when forced through the cage, causes the rolls to move relatively outwardly to deform or expand the tube. The expander also includes a thrust member that has an end that is engageable with the face of the tube sheet and a stop member carried by the cage that engages the thrust member, when the rolls have entered the tubing to the proper distance, to deform the tube the desired amount as well as flaring the ends to the proper position.

6 Claims, 3 Drawing Figures

TUBING EXPANDER FOR BOILER TUBES OR THE LIKE

BACKGROUND OF THE INVENTION

This invention relates generally to improved expanders for expanding tubes in boilers or the like. More particularly, but not by way of limitation, this invention relates to an improved expander for expanding and simultaneously flaring the ends of tubes in boilers or the like.

In the past, considerable difficulty has been encountered in the construction of boilers because of the difficulty of both expanding tubes in the tube sheets and flaring the ends of the tube projecting from the tube sheets to the desired angle. With the type of expanders previously used, placing the expander too deeply into the tubes could result in the inadequate expansion of the tube to form the proper seal. Also, if the expander is set too deep in the tube, the flare may be bent outwardly so that the tube is actually cut off at the face of the tube sheet. If the expander is not placed deeply enough in the tube, the tube may be expanded before the flare rolls are sufficiently engaged to expand the flare to the required degree.

Most often, when expanding and flaring boiler tubes, a torque control device is used that senses the torque applied and automatically shuts the rolling motor off to prevent excess tube expansion and to be sure that all tubes are virtually identical. Improper positioning of the expander relative to the tube ends can cause false indications of torque and, thus, inconsistent expansion.

An object of this invention is to provide an expander wherein the proper depth of insertion of the expander into the tubing is controlled, and thus the expander will consistently and effectively roll and expand the tube to form a seal with the tube sheet while at the same time, forming the required flare on the end of the tube.

SUMMARY OF THE INVENTION

This invention provides an improved tube expander for expanding tube into tight, sealing engagement with a tube sheet or the like and flaring the ends of such tubes projecting from the tube sheet. The improved expander comprises an elongated mandrel having a tapered portion thereon and an annular expander cage encircling a portion of the mandrel having a plurality of spaced slots therein. A plurality of generally straight expander rolls are disposed in some of the slots, and a plurality of tapered flare rolls are disposed in the other slots. A thrust member encircles a portion of the cage and mandrel and has an end engageable with the tube sheet and has a stop member that is mounted on the cage within the thrust member that is engageable with the thrust member to limit the axial movement of the cage relative to the thrust member thereby controlling the depth of entry of the roll into the tube and controlling the maximum flare of the tube ends.

BRIEF DESCRIPTION OF THE DRAWING

The foregoing and additional objects and advantages of the invention will become more apparent as the following detailed description is read in conjunction with the accompanying drawing, wherein like reference characters denote like parts in all views, and wherein.

DETAILED DESCRIPTION OF THE PREFERRED EMBODIMENT

Figure 1:
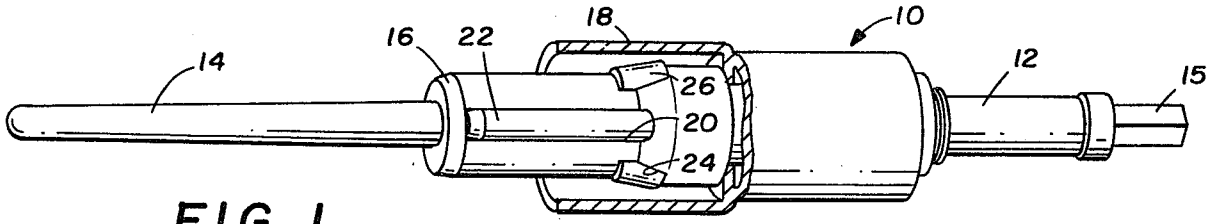
FIG. 1 is a pictorial view, partially in cross-section, illustrating an expander that is constructed in accordance with the invention.

Referring to the drawing, and to FIG. 1 in particular, shown therein and generally designated by the reference character 10, is an improved expander that is constructed in accordance with the invention. As shown therein, the expander 10 includes a mandrel 12 having a tapered nose portion 14 and a square drive 15. The nose portion 14 extends through an annular cage 16 and through an annular thrust member 18 that also encircles a portion of the cage 16.

The cage 16 also includes a plurality of slots 20 that extend generally parallel to the elongated axis of the mandrel 12, and that are sized to receive straight rolls 22. It should be pointed out that the slots 20 and the straight roll 22 are slightly skewed from the axis of the mandrel 12, so that as rotation of the expander 10 occurs, the expander will be drawn into the tube as will be described.

Figure 2:
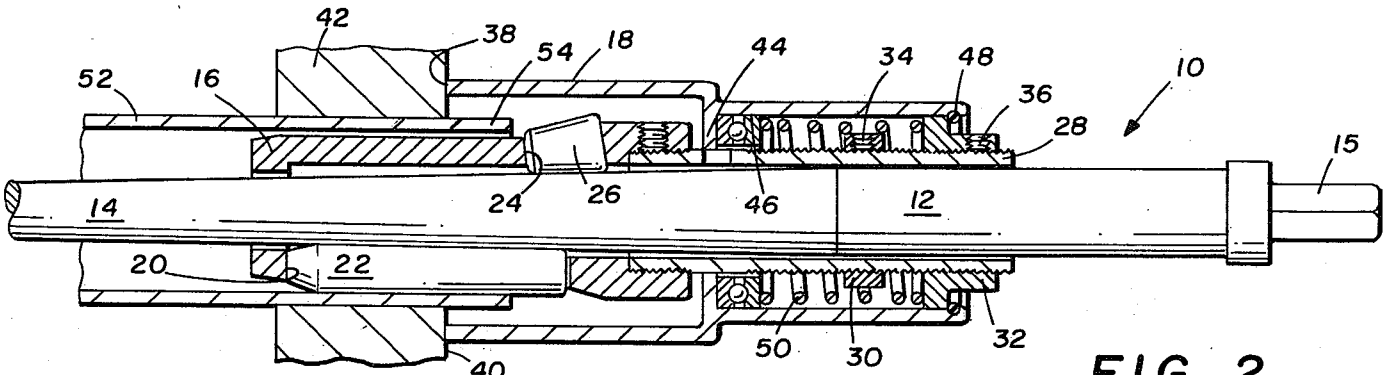
FIG. 2 is a somewhat enlarged cross-sectional view of the expander of FIG. 1.

The cage 16 is also provided with a plurality of slots 24 that are arranged to receive a plurality of tapered flare rolls 26. As can be seen in FIG. 2, the straight rolls 22 and flared rolls 26 are in engagement with the mandrel 12 for reasons that will be discussed hereinafter.

The cage 16 also includes a stem portion 28 that is threaded on its exterior to receive a stop member 30 and an annular member 32. The members 30 and 32 are threaded on to the stem portion 28 and held in any desirable position thereon by set screws 34 and 36 that are located in the members 30 and 32 respectively.

The thrust member 18 includes an end surface 38 that is arranged to engage a face 40 on a tube sheet 42 to properly position the expander 10 relative to the tube sheet 42 for beginning the expanding operation. The thrust member 18 also includes an inwardly directed flange 44 against which there is positioned a thrust bearing 46 that is carried by the thrust member 18. The thrust member 18 extends over the annular member 32 and has a lock ring 48 located therein to prevent the annular member 32 from moving out of the thrust member 18.

Disposed within the thrust member 18 and encircling the stem 28 is an annular compression spring 50 that has one end in engagement with the thrust bearing 46 and the opposite end in engagement with the annular member 32. The spring 50 serves to exert a force on the cage 16 and on the thrust member 18 urging them into the position as illustrated in FIG. 2.

Also shown in FIG. 2 is a tube 52 that is to be expanded into sealing engagement with the tube sheet 42. It will be noted therein that an end 54 of the tube 52 projects past the face 40 of the tube sheet 42.

OPERATION OF THE PREFERRED EMBODIMENT

Figure 3:
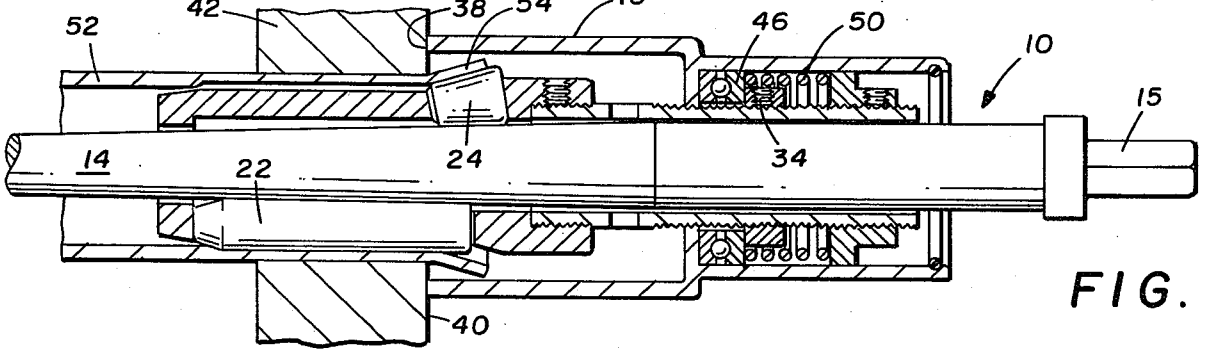
FIG. 3 is a cross-sectional view similar to FIG. 2, but illustrating the expander in the position that it occupies when the tube has been expanded and the ends thereof flared.

After the tube 52 has been positioned in the tube sheet 42 with the end 54 projecting therefrom, the expander 10 is positioned as illustrated in FIG. 2, that is, with the front portion of the cage 16 and a portion of mandrel 14 projecting into the tube 52 which has not been deformed at this point. A driver (not shown) for rotating the mandrel 12 is connected to the square drive 15 thereon, and started to rotate as the mandrel 12 is forced inwardly, that is, toward the face 40 of the tube sheet 42. Movement toward the tube sheet 42 compresses the spring 50, allowing the straight rolls 22 to move into the tube 52. As the rolls 22 engage the interior of the tube 52, movement thereof is arrested and the tapered portion 14 of the mandrel 12 moves inwardly as the rolls 22 are forced outwardly, engaging the interior of the tube 52 deforming the tube as illustrated in FIG. 3.

As previously mentioned, the rolls 22 are slightly skewed relatively to the axis of the mandrel 12, so that rotation causes the expander 10 to screw itself into the tube 52. As this occurs, and as additional force is exerted on the mandrel 12, the rolls 22 deform the tubes 52 as mentioned. As the rolls 22 move into the tube 52, they carry the tapered rolls 24 into engagement with the end 54 of the tube 52, flaring it outwardly as illustrated in FIG. 3. Such inward movement continues until stop member 34 engages the thrust bearing 46.

The mandrel 12 will continue to rotate and move inwardly until the tube 52 has been expanded to its proper size with respect to the tube sheet 42. A torque control device (not shown) is part of the driver for the mandrel 12 and will shut off when the tube 52 has been expanded.

It will be understood of course that the flare 50 of the end 54 of the tube 52 is positively controlled at the desired angle by the solid engagement of the stop member 34 with the thrust bearing 46 and by the engagement of the thrust member 18 with the face 40 of the tube sheet 42. Thus, the proper force can be applied to the tube 52 so that it will be expanded the desired amount without the danger of either cutting off the end 54 because of two much flaring or by failing to flare the end 54 to the required amount.

Having described but a single embodiment of the invention, it will be understood that many changes and variations can be made thereto without departing from the spirit of the invention.

The embodiments of the invention in which an exclusive property or privilege is claimed are defined as follows:

1. A tubing expander for expanding tubing into tight sealing engagement with a tube sheet or the like and flaring the ends of such tubing projecting from the tube sheet, the expander comprising:

an elongated mandrel having a tapered portion thereon;

an annular expander cage encircling a portion of said mandrel, said expander having a plurality of spaced slots therein;

a plurality of generally straight expander rolls disposed in some of said slots;

a plurality of tapered flare rolls disposed in the other of said slots;

a hollow thrust member encircling a portion of said cage and mandrel and having an end engageable with the tube sheet;

an annular member on said cage within said thrust member and engageable with said thrust member to determine the initial position of said cage and expander rolls within the tubing; and, a stop member mounted on said cage within said thrust member and engageable with said thrust member to limit the axial movement of said cage relative to said thrust member thereby controlling the depth of entry of the rolls into said tubing and the maximum flare of the tube ends.

2. The expander of claim 1 and also including a thrust bearing located within and carried by said thrust member and disposed between said thrust member and stop member.

3. The expander of claim 1 and also including resilient means located within said thrust member encircling a portion of said cage for urging said thrust member and stop member relatively apart.

4. The expander of claim 3 wherein said stop member is adjustable relative to said cage whereby the relative movement between said cage and thrust member can be varied.

5. The expander of claim 4 wherein said annular member is adjustable relative to said cage to permit varying the initial position of said cage and expander rolls in the tubing, and wherein said resilient means is a compression spring having one end engaging said thrust member and one end engaging said annular member.

6. The expander of claim 5 and also including a thrust bearing carried by and within said thrust member, said bearing engaging one end of said compression spring and being engageable with said stop member to limit the travel of said cage relative to said thrust member.

* * * * *